US005333714A

United States Patent [19]

Watabe et al.

[11] Patent Number: 5,333,714

[45] Date of Patent: Aug. 2, 1994

[54] BILL DISCRIMINATING APPARATUS

[75] Inventors: Masayuki Watabe, Moroyama; Yoshinori Maruyama, Kawagoe; Takashi Ono, Sakado, all of Japan

[73] Assignee: Nippon Conlux Co., Ltd., Tokyo, Japan

[21] Appl. No.: 943,431

[22] Filed: Sep. 10, 1992

[30] Foreign Application Priority Data

Sep. 12, 1991 [JP] Japan ..... 3-233414

[51] Int. Cl.[5] ..... G07D 7/00

[52] U.S. Cl. ..... 194/206; 271/181

[58] Field of Search ..... 194/206, 207; 209/534; 271/177, 180, 181

[56] References Cited

U.S. PATENT DOCUMENTS 4,834,230 5/1989 Kondor et al. ..... 194/206

4,880,096 11/1989 Kobayashi et al. ..... 194/206

FOREIGN PATENT DOCUMENTS 0308060 3/1989 European Pat. Off. .

3042566 8/1981 Fed. Rep. of Germany .

617782 6/1980 Switzerland .

*Primary Examiner*—F. J. Bartuska

*Attorney, Agent, or Firm*—Spensley Horn Jubas & Lubitz

[57] ABSTRACT

In a bill discriminating apparatus, a bill stacking unit is adapted for detachable attachment to a bill discriminating unit at both an up-stacking position and a down-stacking position. At the up-stacking position the stacking unit is arranged at a position higher than the bill discriminating unit whereas at the down-stacking position the stacking unit is arranged at a position lower than the bill discriminating unit. The bill stacking unit is detachably attached by a detachable attaching mechanism to the bill discriminating unit at one of both the up-stacking position and the down-stacking position. A torque is transmitted by a torque transmitting mechanism from a drive mechanism of a bill conveyer of the bill discriminating unit to a drive pulley of the stack conveyer of the stacking unit.

6 Claims, 4 Drawing Sheets

BILL DISCRIMINATING APPARATUS

BACKGROUND OF THE INVENTION

The present invention relates to a bill discriminating apparatus. In this specification and the claims, the term "bill" is referred to a paper money and the like valuable sheet material.

Generally, automatic vending machines and money exchangers are provided with a bill discriminating unit for judging whether or not bills inserted are genuine. Such machines further include a bill stacker unit for stacking only accepted genuine bills in it. To stack bills this kind of bill discriminating unit adopts one of two stacking fashions; an up-stacking fashion and a down-stacking fashion. In the former, bills, inserted from a lower insert slot, are judged by the bill discriminating unit whether or not they are genuine, and accepted genuine bills are then upwardly transported for stacking them above the discriminating unit. On the other hand, in the latter fashion, bills, inserted from an upper insert slot, are also judged by the bill discriminating unit to discriminate genuine bills from counterfeit ones, and accepted genuine bills are then downwardly conveyed for stacking them below the discriminating unit. Users may select one of the two fashions considering the conditions of use, and a bill discriminating apparatus of the selected fashion is incorporated into the automatic vending machine.

However, in the case where after such a selection, the bill discriminating apparatus should be changed to the other fashion, the whole bill discriminating apparatus must be changed to a bill discriminating apparatus of the other fashion.

SUMMARY OF THE INVENTION

Accordingly, it is an object of the present invention to provide a bill discriminating apparatus which is capable of changing one stacking fashion to the other stacking fashion, that is, from the up-stacking fashion to the down-stacking fashion or vice versa, with ease and without deteriorating the performance thereof.

In view of this and other objects, the present invention provides a bill discriminating apparatus of the type comprising: a bill discriminating unit including a feed conveyer for receiving and conveying bills, and bill discriminating means arranged in the vicinity of the belt conveyer, the feed conveyer having a drive pulley and a driven pulley and an endless belt extending between the drive pulley and the driven pulley; drive means for driving the drive pulley of the feed conveyer; a bill stacking unit including stacking means for stacking bills, a stack conveyer for conveying bills to the stacking means, and guide means for receiving bills from the feed conveyer and for guiding the bills to the stack conveyer, the bill stacking unit being adapted for detachable attachment to the bill discriminating unit at both an up-stacking position and a down-stacking position, wherein: at the up-stacking position the stacking means is arranged at a position higher than the bill discriminating unit; and at the down-stacking position the stacking means is arranged at a position lower than the bill discriminating unit; detachably attaching means for detachably attaching the bill stacking unit to the bill discriminating unit at both the up-stacking position and the down-stacking position; and torque transmitting means for transmitting a torque from the drive means to the drive pulley of the stack conveyer.

DETAILED DESCRIPTION OF THE PREFERRED EMBODIMENT

Figure 1:
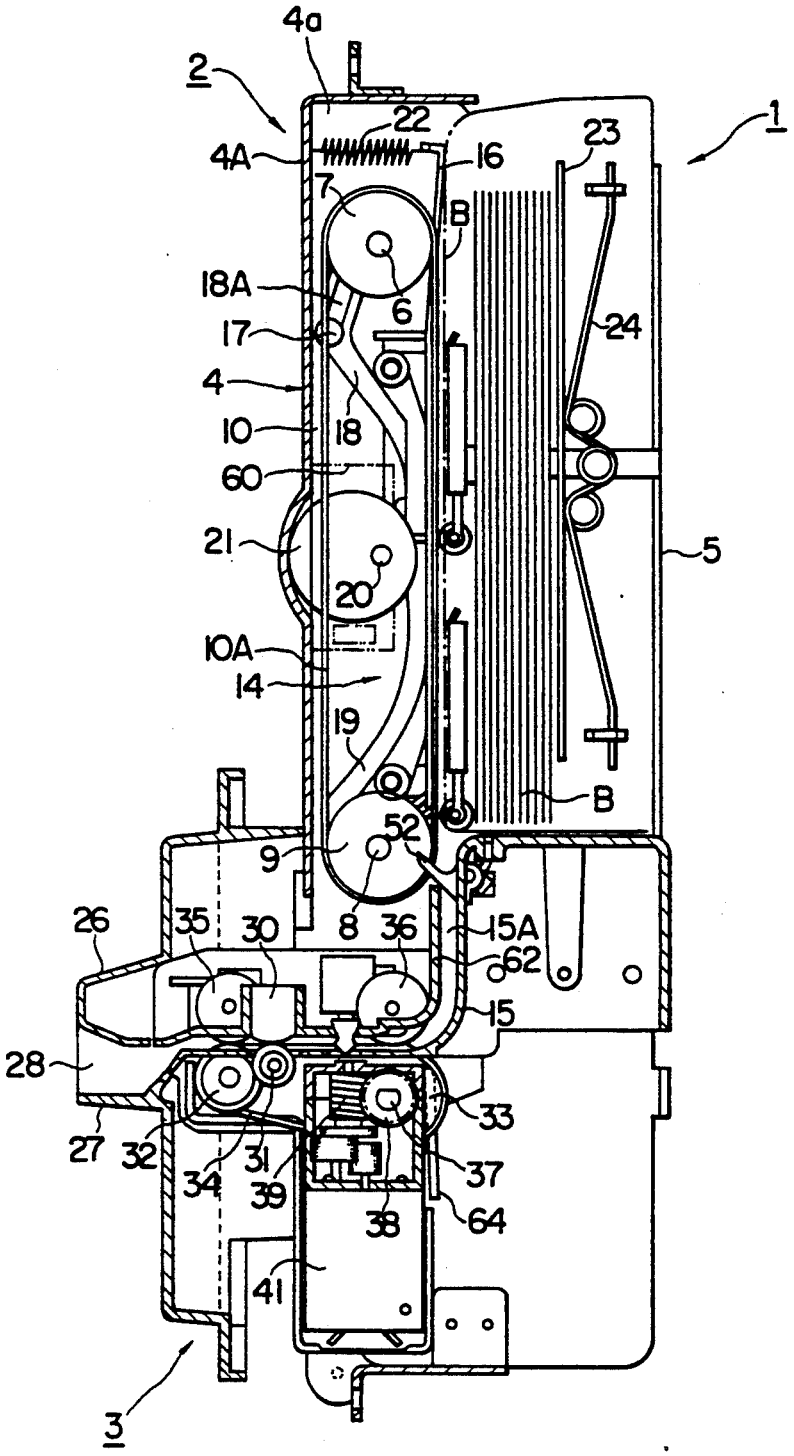
FIG. 1 is a vertical cross-sectional view of a bill discriminating apparatus of an up-stacking fashion according to the present invention.

Referring to the drawings a bill discriminating apparatus of the present invention will be described hereinafter.

FIG. 1 illustrates a bill discriminating apparatus 1 assembled in an up-stacking fashion, and the bill discriminating apparatus 1 includes a bill stacker unit 2 for receiving genuine bills, and a bill discriminating unit 3 detachably mounted to a lower portion of the bill stacker unit 2. Each of the bill stacker unit 2 and the bill discriminating unit 3 is symmetrical about the vertical center thereof, and therefore only the right hand side thereof will be described hereinafter.

The bill stacker unit 2 includes a stacker body 4, and an accumulating box 5 which is detachably attached to the stacker body 4 and accumulates bills in it. The stacker body 4 is provided with a casing 4A. A pair of parallel belt conveyers 10 and 10 are vertically mounted within the casing 4A at a horizontal interval. Each of the belt conveyers 10 and 10 includes a pair of an upper pulley 7 and a lower pulley 9 and an endless belt 10A extending between and around the upper pulley 7 and the lower pulley 9. Each pair of the upper pulley 7 and lower pulley 9 are respectively mounted around a rotary shaft 6 and a rotary shaft 8 which are rotatably supported on the casing 4A. As clearly shown in FIGS. 3(B) and 4(B), the opposite ends of the rotary shaft 8 pass through side walls 4*a* and 4*a* of the casing 4A, and have each a driven gear 11 mounted to them. Each of the driven gears 11 meshes with an idle gear 13 which is rotatably mounted on a shaft 12 fixed to the side wall 4*a*. The casing 4A has a switch (not shown) for detecting whether or not the accumulating box 5 is attached to it.

Returning to FIG. 1, a pushing unit 14 is provided within the casing 4A between the belt conveyers 10 and 10. The pushing unit 14 includes a pushing plate 16, a pair of links 18 and 19, and an eccentric cam 21. The pushing plate 16 is adapted to push backwardly a bill B which has been conveyed along the vertical bill passage 15A to a stacking position shown by the dots-and-dash line in FIG. 1. Each of the links 18 and 19 is pivotally attached at its one end to the front surface of the pushing plate 16, and is slidably mounted at the other end to a fixed shaft 17 which passes through a slot 18A formed through the link. The links 18 and 19 are similar to each other, and In FIG. 1, the fixed shaft 17 and the slot of the link 19 are therefore not shown. The eccentric cam 21 is mounted on an output shaft of a stack motor unit 60 to rotate around a rotation center 20. The pushing plate 16 is spring biased toward the bill stacker unit 2 by a pair of coil springs 22 and 22, only one of which is shown. A compressing plate 23 is arranged within the accumulating box 5 and is urged forwardly or to the left in FIG. 1 by a spring bar 24. A turning plate 15 is provided to the bottom of the accumulating box 5, and is curved so that horizontally conveyed bills are turned upwardly to progress along the vertical bill passage 15A. The vertical bill passage 15A is defined between the turning plate 15 and upper turning plate 62 mounted to an upper frame 26 of the bill discriminating unit 3.

Figure 2:
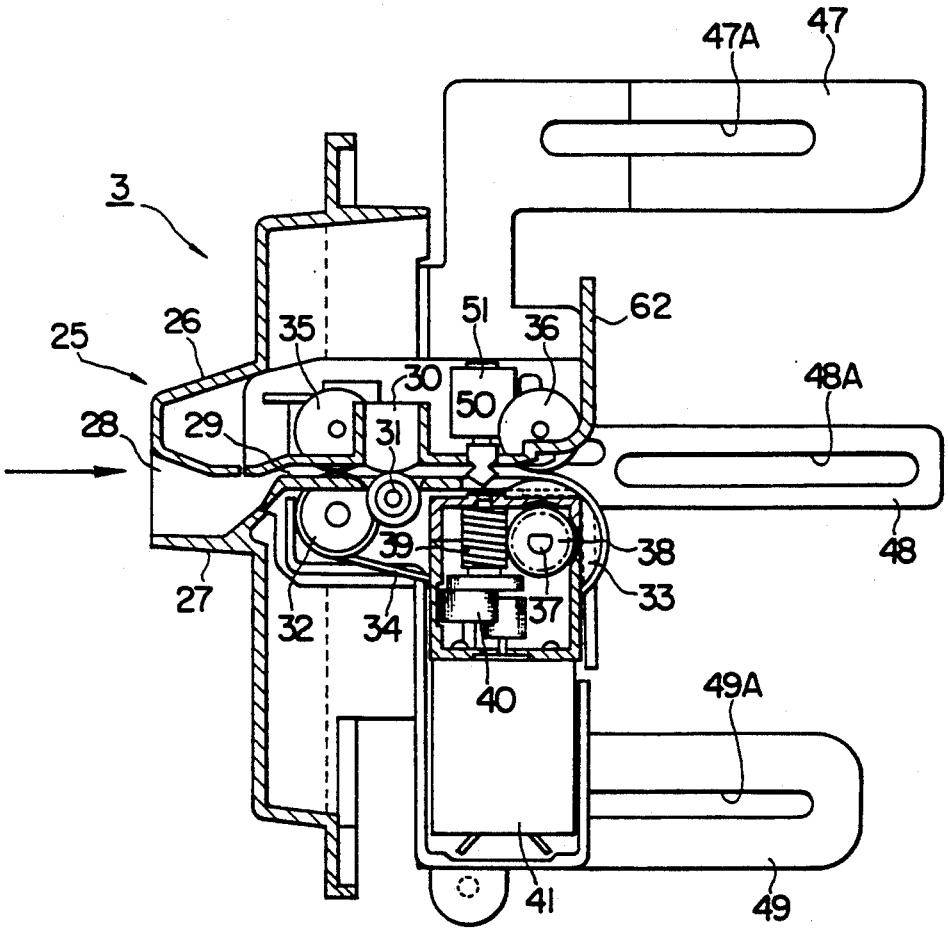
FIG. 2 is an enlarged vertical cross-sectional view of the bill discriminating unit of FIG. 1.

As best shown in FIG. 2, the bill discriminating unit 3 is provided with a frame 25, which includes the upper frame 26 and a lower frame 27. Between the upper and lower frames 26 and 27 there are formed an inlet slot 28 and a horizontal bill passage 29 communicating to the inlet slot 28. An inlet sensor (not shown) is provided to the inlet slot 28 for detecting a bill, and a magnetic head 30 is mounted closely to the horizontal bill passage 29 for judging whether or not the bill is genuine. Furthermore, several photosensors (not shown) are arranged to discriminate a forfeit bill from a genuine one. A head pinch roller 31 is arranged to oppositely face the magnetic head 30.

A driven pulley 32 and a drive pulley 33 are disposed upstream and downstream of the pinch roller 31, respectively. An endless belt 34 extends in a parallel fashion between and around the pulleys 32 and 33. Pinch rollers 35 and 36 press the pulley 32 and 33 through the belt 34, respectively. The drive pulley 33 is mounted around a drive shaft 37, on which a worm wheel 38 is mounted. The worm wheel 38 meshes with a worm 39, which is rotated by a drive motor 41 through a reduction gear 40 including several gears.

Figure 3C:
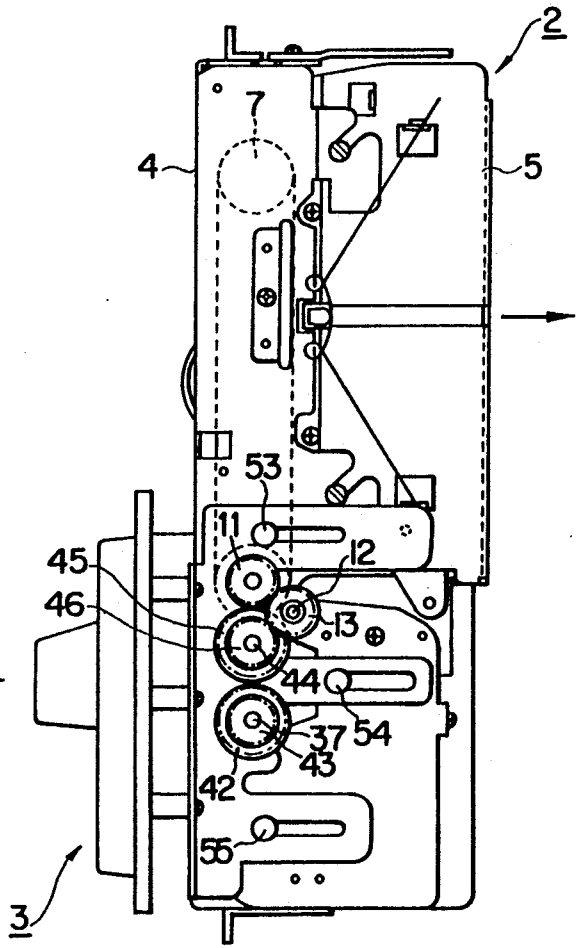
FIGS. 3(A) to 3(C) are side views reduced on scale and illustrating how to assemble the bill discriminating apparatus of the up-stacking fashion of FIG. 1.
Figure 3B:
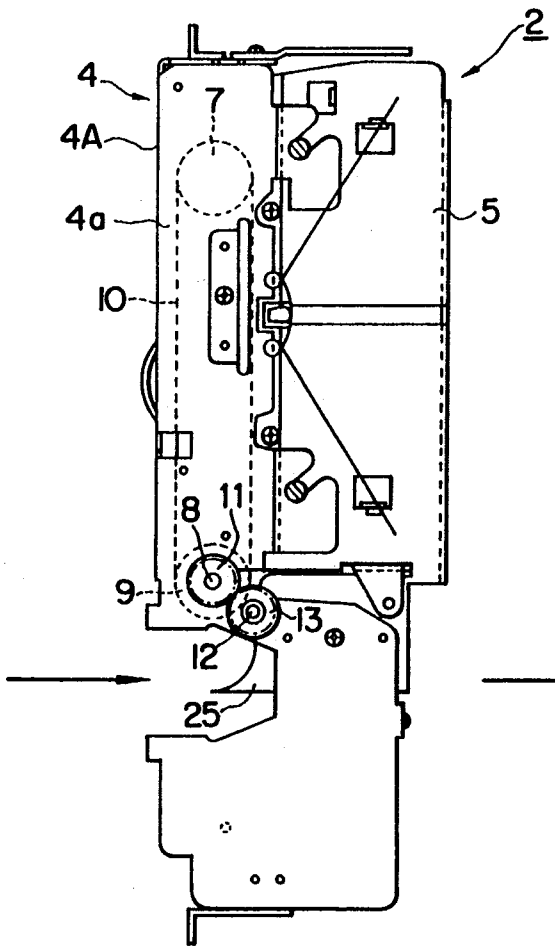
Figure 3A:
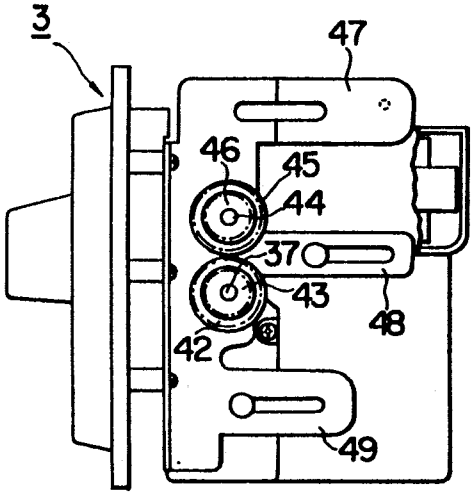

The drive shaft 37 passes at one end thereof through the lower frame 27, and as shown in FIG. 3(A), a large gear 42 and small gear 43 are coaxially mounted around the drive shaft 37. The large gear 42 meshes with another large gear 45 having the same number of teeth as the gear 42. The large gear 45 and another small gear 46, which has the same number of teeth as the small gear 43, are coaxially mounted on a shaft 44 rotatably supported on the upper frame 26. As best shown in FIG. 2, an upper bracket 47, an intermediate bracket 48, and a lower bracket 49 are integrally formed with the frame 25 of the bill discriminating unit 3, and these brackets are fastened to the bill stacker unit 2 through bolts 53–55 which pass through slots 47A–49A thereof. The reference numeral 50 designates a shutter which blocks bills from being pulled out. The shutter 50 is driven by a drive solenoid 51, and is provided with a photointerrupter switch (not shown) to detect the movement of the shutter 50. In FIG. 1, the reference numeral 52 indicates a pull-out-preventing lever.

Referring to FIGS. 3(A) to 3(C), how to assemble a bill discriminating apparatus 1 in the up-stacking fashion will be described. FIGS. 3(A) and 3(B) illustrate the disassembled bill discriminating unit 3 and bill stacker unit 2, respectively, and FIG. 3(C) shows an assembled bill discriminating apparatus 1.

As shown in FIG. 3(B), the bill stacker unit 2 is positioned vertically with the lower pulley 9 located below the upper pulley 7, and is then leftwardly fitted to the bill discriminating unit 3 as shown in FIGS. 3(A) and 3(B). In this event, the small gear 46 meshes with the right side idle gear 13 as shown in FIG. 3(C). In this manner the bill stacker unit 2 is placed in an up-stacking position, and is fastened to the bill discriminating unit 3 by means of bolts 53, 54 and 55.

In this state, a bill is inserted through the inlet slot 28, and is then pulled in the bill discriminating unit 3 by the conveyer belt 34. During this transportation, the bill is judged by the magnetic head 30 and the other sensors as to whether or not it is genuine. When the answer is affirmative, the bill is transported upwardly along the turning plate 15, so that the bill is drawn by the endless belts 10A and 10A into the vertical bill passage defined between the endless belts 10A and 10A and the pushing plate 16. When the bill reaches to a stack position at B, the motor 60 is energized to rotate the eccentric cam 21 for pushing the pushing plate 16 backwardly. In this manner, the bill is stacked within the accumulating box 5 over the compression plate 23.

Figure 4C:
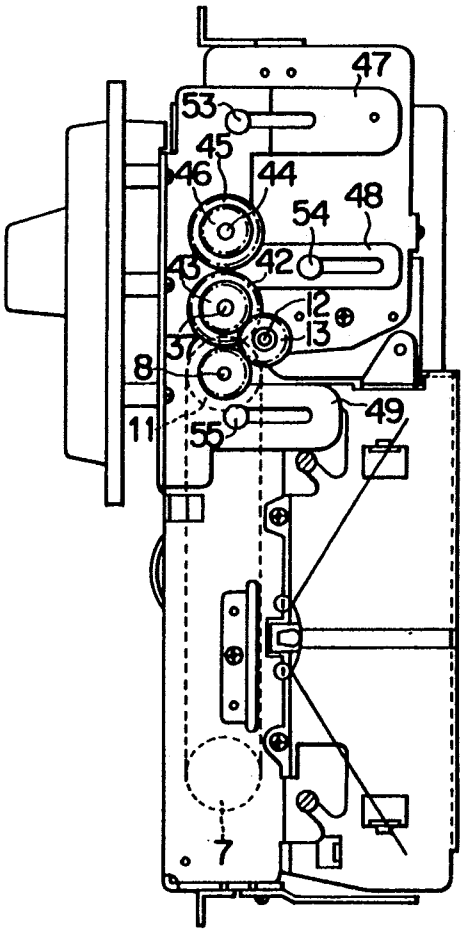
FIGS. 4(A) to 4(C) are side views illustrating how to assemble the bill discriminating apparatus of a down-stacking fashion.
Figure 4B:
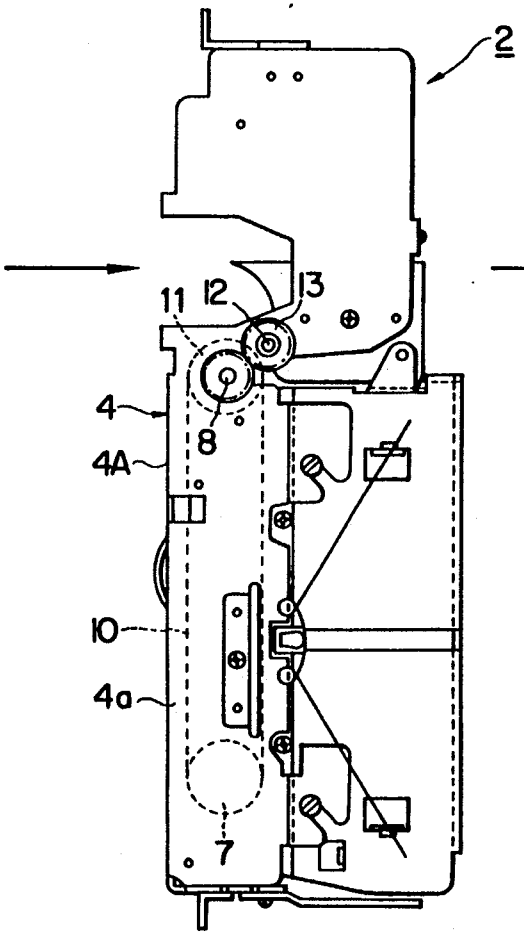
Figure 4A:
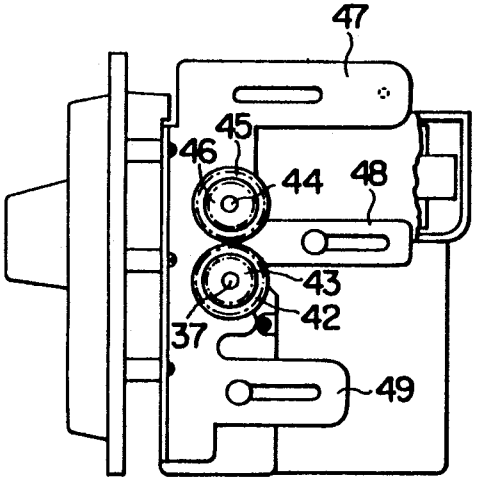

On the other hand, FIGS. 4(A) to 4(C) show how to assemble a bill discriminating apparatus 1 in a down-stacking manner. The bill stacker unit 2 is positioned vertically with the lower pulley 9 located above the upper pulley 7, and is then leftwardly fitted to the bill discriminating unit 3 as in FIGS. 4(A) and 4(B). In this event, the small gear 43 meshes with the left side idle gear 13 as shown in FIG. 4(C). In this manner the bill stacker unit 2 is placed in an down-stacking position, and is fastened to the bill discriminating unit 3 by means of bolts 53, 54 and 55. In this case, part of the vertical bill passage is defined between the turning plate 15 of the bill stacking unit 2 and a lower turning plate 64 (FIG. 1) of the bill discriminating unit 3.

Also, in this case a bill is inserted through the inlet slot 28, and is then pulled in the bill discriminating unit 3 by the conveyer belt 34. As in the up-stacking fashion, during this transportation, the bill is judged by the magnetic head 30 and the other sensors as to whether or not it is genuine. When the answer is affirmative, the bill is transported downwardly along the turning plate 15, so that the bill is drawn by the endless belts 10A 10A into the vertical bill passage defined between the endless belts 10A and 10A and the pushing plate 16. When the bill reaches to a stack position at B, the motor 60 is energized to rotate the eccentric cam 21 for pushing the pushing plate 16 backwardly. In this manner, the bill is stacked within the accumulating box 5 over the compression plate 23.

What is claimed is:

1. A bill discriminating apparatus of the type comprising:

a bill discriminating unit including a feed conveyer for receiving and conveying bills, and bill discriminating means arranged in the vicinity of the feed conveyer, the feed conveyer having a drive pulley with a drive shaft and a driven pulley and an endless belt extending between the drive pulley and the driven pulley;

drive means for driving the drive pulley of the feed conveyer;

a bill stacking unit including stacking means for stacking bills, a stack conveyer for conveying bills to the stacking means and having a drive pulley with a drive shaft, and guide means for receiving bills from the feed conveyer and for guiding the bills to the stack conveyer, the bill stacking unit being adapted for detachable attachment to the bill discriminating unit at both an up-stacking position and a down-stacking position, wherein: at the up-stacking position the stacking means is arranged at a position higher than the bill discriminating unit; and at the down-stacking position the stacking means is arranged at a position lower than the bill discriminating unit;

detachably attaching means for detachably attaching the bill stacking unit to the bill discriminating unit at both the up-stacking position and the down-stacking position; and torque transmitting means for transmitting a torque from the drive means to the drive pulley of the stack conveyer, said torque transmitting means comprising a first spur gear mounted around the drive shaft of the drive pulley of the feed conveyer, a second spur gear mounted around the drive shaft of the drive pulley of the stack conveyer, and a gear train adapted to mesh with the first and second spur gears for transmitting the torque from the first spur gear to the second spur gear.

2. A bill discriminating apparatus of the type comprising:

a bill discriminating unit including a feed conveyer for receiving and conveying bills, and bill discriminating means arranged in the vicinity of the feed conveyer, the feed conveyer having a drive pulley with a drive shaft and a driven pulley and an endless belt extending between the drive pulley and the driven pulley;

drive means for driving the drive pulley of the feed conveyer;

a bill stacking unit including stacking means for stacking bills, a stack conveyer for conveying bills to the stacking means and having a drive pulley with a drive Shaft, and guide means for receiving bills from the feed conveyer and for guiding the bills to the stack conveyer, the bill stacking unit being adapted for detachable attachment to the bill discriminating unit at both an up-stacking position and a down-stacking position, wherein: at the up-stacking position the stacking means is arranged at a position higher than the bill discriminating unit; and at the down-stacking position the stacking means is arranged at a position lower than the bill discriminating unit;

detachably attaching means for detachably attaching the bill stacking unit to the bill discriminating unit at both the up-stacking position and the down-stacking position; and torque transmitting means for transmitting a torque from the drive means to the drive pulley of the stack conveyer; wherein the bill stacking unit comprises a casing, having opposite side walls, for receiving the stack conveyer therein;

the drive shaft of the drive pulley of the stack conveyer has opposite end portions passing through respective side walls of the casing;

the torque transmitting means comprises: a stack spur gear mounted around each of the opposite end portions of the drive shaft of the drive pulley of the stack conveyer; and spur gear means, operatively connected to the drive shaft of the drive pulley of the feed conveyer; and one of the stack spur gears is adapted to mesh with the spur gear means when the bill stacking unit is placed at the up-stacking position whereas the other stack spur gear is adapted to mesh with the spur gear means when the bill stacking unit is placed at the down-stacking position.

3. A bill discriminating apparatus as recited in claim 2, wherein:

the spur Gear means comprises a drive spur gear, a first pinion coaxially mounted to the drive spur gear, an idle spur gear meshing with the drive spur gear, and a second pinion coaxially mounted to the idle spur gear; and the one stack spur gear is adapted for operative engagement with the first pinion when the bill stacking unit is placed at the up-stacking position whereas the other stack spur gear is adapted for operative engagement with the second pinion when the bill stacking unit is placed at the down-stacking position.

4. A bill discriminating apparatus as recited in claim 3, wherein:

the spur gear means further comprises a stack idle spur gear rotatably mounted on each of the side walls of the casing to mesh with a corresponding stack spur gear: and one stack idle spur gear is adapted for engagement with the second pinion when the bill stacking unit is placed at the up-stacking position whereas the other stack idle spur gear is adapted for engagement with the first pinion when the bill stacking unit is placed at the down-stacking position.

5. A bill discriminating apparatus as recited in claim 3, wherein the detachably attaching means comprises adjusting means for adjusting both the engagement of the one stack spur gear with the first pinion and the engagement of the other stack spur gear with the second pinion.

6. A bill discriminating apparatus as recited in claim 5, wherein: the adjusting means comprises slot means, provided to the bill discriminating unit, for defining slots; and fastening members adapted for slidably passing through respective slots to fasten the bill discriminating unit to the bill stacking unit.

* * * * *